United States Patent [19]

Stupp et al.

[11] Patent Number: 4,498,031

[45] Date of Patent: Feb. 5, 1985

[54] VARIABLE FREQUENCY CURRENT CONTROL DEVICE FOR DISCHARGE LAMPS

[75] Inventors: Edward H. Stupp, Spring Valley, N.Y.; Mark W. Fellows, Monroe, Conn.

[73] Assignee: North American Philips Corporation, New York, N.Y.

[21] Appl. No.: 455,395

[22] Filed: Jan. 3, 1983

[51] Int. Cl.[3] ..... H05B 37/02

[52] U.S. Cl. ..... 315/307; 315/210; 315/219; 315/224; 315/239

[58] Field of Search ..... 315/307, 114, 151, 224, 315/239, 210, 219

[56] References Cited

U.S. PATENT DOCUMENTS

| | | | |
|---|---|---|---|
| 2,928,994 | 3/1960 | Widakowich | 331/114 |
| 3,072,822 | 1/1963 | Holmes | 315/307 |
| 3,265,930 | 8/1966 | Powell | 315/307 |
| 3,449,629 | 6/1969 | Wigert et al. | 315/151 |
| 3,611,021 | 10/1971 | Wallace | 315/239 |
| 3,890,537 | 6/1975 | Park et al. | 315/307 |
| 4,060,752 | 11/1977 | Walker | 315/224 |
| 4,253,046 | 2/1981 | Gerhard et al. | 315/307 |

*Primary Examiner*—Harold Dixon

*Attorney, Agent, or Firm*—Robert T. Mayer; Bernard Franzblau

[57] ABSTRACT

A control circuit for starting and operating a gas discharge lamp comprising a variable frequency waveform generator coupled to the discharge lamp via a non-resonant coupling network that includes a reactance type ballast impedance. The lamp current is monitored to automatically vary the frequency of the variable frequency generator as a function of the lamp current so as to vary the reactance of the ballast impedance in a sense to regulate or limit the lamp current.

5 Claims, 4 Drawing Figures

VARIABLE FREQUENCY CURRENT CONTROL DEVICE FOR DISCHARGE LAMPS

BACKGROUND OF THE INVENTION

This invention relates to a control circuit for starting and operating gas discharge lamps and, more particularly, to a control circuit of this type which provides automatic current regulation as a function of the lamp current by means of automatic frequency control.

Starting and ballasting circuits are required for the stable and efficient operation of gas discharge lamps. Recent developments in the art of control circuits for discharge lamps indicate that improved operating characteristics are obtainable by operation of the lamps at high frequencies, e.g. at frequencies above about 5 Khz.

Various types of ballast circuits are well known in the art for controlling the operation of gas discharge lamps. For example, U.S. Pat. No. 4,060,751 by T. E. Anderson describes a control circuit for operating a gas discharge lamp utilizing a frequency controlled inverter and a resonant matching network. The resonant circuit consists of an inductor connected in series with the parallel combination of a capacitor and the gas discharge lamp. The discharge lamp is connected as a damping element across the capacitor of an otherwise high Q series resonant circuit. Prior to ignition, the lamp presents a very high impedance so that the Q of the resonant circuit remains high and the circuit is automatically driven at its resonant frequency. A voltage buildup occurs in the high Q circuit to provide the high voltage necessary to initiate a discharge in the lamp. After ignition, the lamp's impedance decreases greatly, thereby loading the resonant circuit and lowering its Q. The inverter then functions as a current regulator in which the inductor of the control circuit limits the current flow through the negative lamp impedance thereby to limit the lamp input power and provide stable operation. An increase in the DC supply voltage produces an increase in the inverter operating frequency and therefore an increase in the impedance of the inductor.

U.S. Pat. No. 4,060,752 by L. H. Walker also discloses a variable frequency ballast circuit providing a regulated, constant output power to a gas discharge lamp. The discharge lamp is again connected in parallel with the capacitor of a series resonant LC circuit. The operating frequency of an inverter or variable frequency square wave oscillator is controlled by a frequency control circuit which is in turn controlled either as a function of the time derivative of the lamp current via a dI/dT sensor or as a function of the amplitude of the lamp current. The control circuit maintains constant power to the lamp via the resonant matching circuit and exhibits an operating frequency which increases as the load impedance increases.

A variable frequency inverter-ballast control circuit for regulating the current in a gas discharge lamp is disclosed in U.S. Pat. No. 3,611,021 in the name of K. A. Wallace. This control circuit energizes the discharge lamp via a leakage reactance transformer in combination with a first capacitor connected across the transformer secondary and a second capacitor connected in series with the lamp and selected to be near resonance with the transformer leakage reactance at the fundamental frequency of a variable frequency square wave inverter. The first capacitor resonates with the transformer leakage reactance at a selected harmonic of the inverter fundamental frequency. The harmonic resonant voltage is added to the transformer fundamental voltage to produce a voltage sufficient to ignite the discharge lamp. After ignition, the equivalent series impedance of the second capacitor and the transformer winding at the fundamental inverter frequency provides the necessary ballast for stable lamp operation. A current sensing circuit senses the level of the lamp current and feeds back an error signal to adjust the inverter fundamental frequency in a sense to maintain the lamp current constant.

U.S. Pat. No. 2,928,994 by M. Widakowich shows a variable frequency inverter whose frequency varies as a function of a DC supply voltage so as to maintain the current in a fluorescent lamp constant despite any variations in the level of said supply voltage.

SUMMARY OF THE INVENTION

Accordingly, it is an object of the present invention to provide an improved variable high frequency control circuit which produces reliable ignition and stable and efficient operation of one or more gas discharge lamps.

High frequency operation of gas discharge lamps provides higher efficacy than low frequency operation and also permits the use of reactive components of much smaller size, a saving in cost and size of the apparatus.

In accordance with one embodiment of the invention, the various objects, advantages and features are attained by means of a variable frequency, current fed, driven inverter circuit which regulates the discharge lamp current by continuously sampling the lamp current to provide a signal that controls the frequency of the inverter circuit in a sense so as to maintain the lamp current constant. The system will control lamp current by continuously monitoring the current and feeding back a signal to the input of a current-to-frequency converter. The current-to-frequency conversion can be implemented by means of digital or analog circuits. An intermediate current-to-voltage conversion could be used followed by a voltage-to-frequency conversion. The output of the converter is applied to a driven inverter circuit which results in a substantially load independent system, an important feature since a reactive element is used to control and limit the lamp current.

An additional advantage of a driven inverter circuit operation is that an output transformer, if used, will be non-saturating. The control circuit is adapted to use MOS transistors thereby reducing the drive power requirements to a minimum. The lamps may be operated either in a series or a parallel arrangement with the lamp current limited and controlled by a series reactance. The converter circuit will respond to lamp current with an upper and lower frequency limit and a center frequency related to the lamp optimum operating point.

Another feature of the invention is that a relatively small power supply filter capacitor may be used because the variable frequency control of the driven inverter circuit provides optimum load current regulation despite a substantial 120 Hz ripple component in the rectified DC supply voltage applied to the inverter.

In a preferred embodiment of the invention an inductor is connected in series between the output of the rectifier and a center tapped inductor in the inverter circuit thus providing current feed to the inverter. This inductor also acts as a high impedance to prevent high frequency currents from feeding back into the AC power lines. Another feature of the invention is the provision of a driven inverter operating a tapped non-saturating inductor push-pull, or a non-saturating output transformer. A high system power factor is also possible with this invention.

A reference level circuit may be incorporated into the current-to-voltage converter so that the lamp current, and hence the inverter frequency, will vary about a given level. This level may be adjusted so as to dim the lamps or perform some other control functions.

It will be apparent from the foregoing that the present invention does not require the use of a resonant circuit for its operation and thus provides certain additional advantages over the prior art discussed above. The present invention thus provides a fixed open circuit voltage whereas, for example, in U.S. Pat. No. 4,060,752, the voltage increases without limit if the lamp is removed from the circuit. This produces a safety problem which is not present in the non-resonant driven inverter circuit disclosed herein.

In another preferred embodiment of the invention, we provide a control circuit including a variable frequency triangular waveform current source driving an inductively ballasted discharge lamp. The sense or direction of the triangular waveform current (positive or negative) is controlled by a threshold detection circuit. When the lamp current reaches a predetermined peak value, the threshold detector triggers a bistable device thereby to generate an equal and opposite slope of the lamp triangle waveform current. Thus, for a constant load and a constant supply voltage, a constant frequency triangle waveform is generated.

If the load impedance decreases or the supply voltage increases, the triangle waveform current will reach the threshold levels sooner, (i.e. the slope of the waveform increases) and thus cause the frequency thereof to increase. A higher frequency increases the impedance of a series ballast inductor so as to automatically limit the amplitude of the lamp current. The lamp current is automatically regulated as the frequency of the triangle waveform generated varies with changes in the load or the supply voltage and in a sense so as to maintain the lamp current constant.

Advantageously, the triangular waveform current may be generated by producing a voltage consisting of a square wave plus a triangular wave in which the triangular wave is derived by integrating the square wave produced by the flip-flop. The triangle and square waves are then combined in an adder circuit. The resultant trapezoidal voltage waveform is applied to the lamp via a ballast element to produce a triangular waveform current in the lamp. An advantage of this embodiment of the invention is that current regulation for a discharge lamp can be achieved by means of a relatively simple and inexpensive control circuit.

Another feature of this embodiment is that the peak turnaround threshold voltage levels can be easily adjusted thereby to provide a simple dimming function for the circuit.

A further object of the invention is to provide a power supply for a gas discharge lamp that supplies a waveform adapted to produce a constant current in the lamp.

BRIEF DESCRIPTION OF THE DRAWINGS

The novel features characteristic of the present invention are set forth in the appended claims. The invention itself, together with further objects and advantages thereof, may best be understood by reference to the following detailed description, taken in connection with the accompanying drawings in which:

DESCRIPTION OF THE PREFERRED EMBODIMENTS

Figure 1:
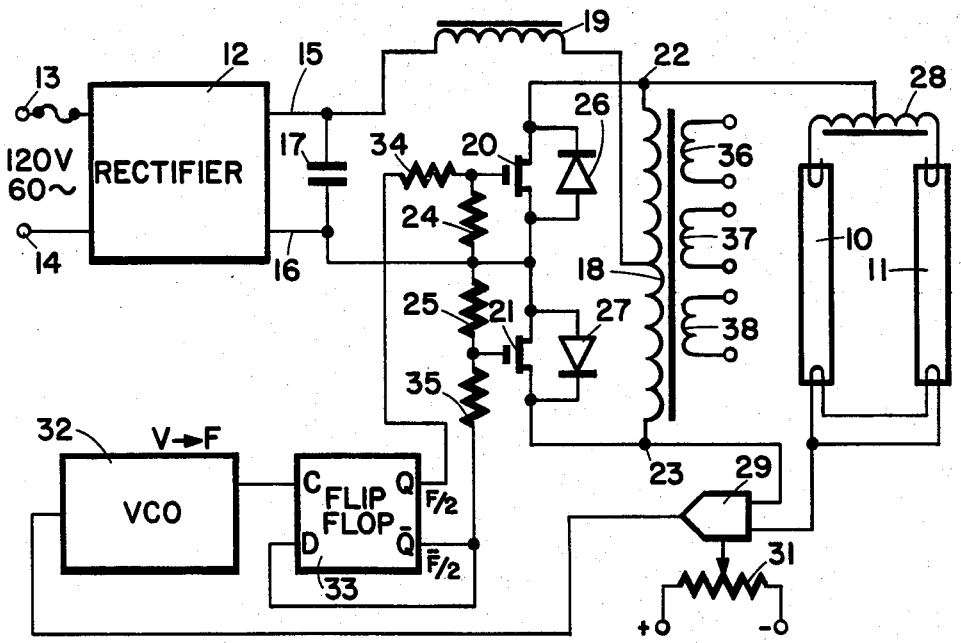
FIG. 1 is a functional block schematic diagram of a preferred embodiment of the invention.

FIG. 1 shows a variable frequency control device for starting and operating a pair of gas discharge lamps 10 and 11. A conventional full wave diode bridge rectifier 12 has a pair of input terminals connected to the supply terminals 13, 14 of a 60 Hz AC source of supply voltage. The rectifier has a positive output terminal 15 and a negative output terminal 16 across which a filter capacitor 17 of minimum value is connected. A rectified pulsating unidirectional voltage having a substantial 120 Hz ripple component appears at the rectifier output terminals 15, 16 and is applied to a push-pull current fed variable frequency driven inverter circuit.

The positive terminal 15 of the DC power supply is connected to a center tap of an inductor 18 via a series connected inductor 19 which provides current feed to the inverter circuit. The inductor 19 also functions as a high impedance to high frequencies thereby preventing high frequency energy from feeding back into the AC supply via the full wave rectifier circuit 12.

A pair of MOS transistors 20 and 21 have their drain electrodes connected to the end terminals 22 and 23, respectively, of the inductor 18. The source electrodes of transistors 20 and 21 are directly connected together and to the negative terminal 16 of the DC power supply 12. Resistors 24 and 25 are connected between the gate and source electrodes of their respective transistors 20 and 21. Diodes 26 and 27 are connected across the source and drain electrodes of transistors 20 and 21, respectively. Diodes 26 and 27 may be the body diodes internal to the structure of transistors 20 and 21, respectively.

Terminal 22 is connected to a center tap on ballast inductor 28 and the end terminals of this inductor are each connected to one electrode of the lamps 10 and 11 so that one half of the inductor is in series with the discharge lamp 10 and the other half is in series with the discharge lamp 11. The other electrodes of the lamps 10 and 11 are connected together and to an input of a conventional current-to-voltage converter 29. Terminal 23 of the inductor 18 is also connected to the input of the converter circuit 29. This converter circuit preferably comprises a transducer with an internal reference level so as to provide a means for adjusting the nominal level of the lamp current. This is illustrated schematically by means of a potentiometer 31 coupled to the converter circuit 29. The lamp current, and thus the frequency of the driven inverter circuit, can be adjusted to different values so as to provide a dimming feature for the lamps, or to perform other control functions.

The current-to-voltage converter 29 samples the lamp current and produces a rectified signal that is applied to the input of a voltage-to-frequency converter circuit 32, for example a voltage controlled oscillator such as is present in a type 4046 IC. The current-to-voltage and voltage-to-frequency stages may be replaced by a single circuit that performs directly the functions of the two separate stages.

The variable frequency output signal of the VCO 32 is applied to the C input of a D-type flip-flop 33. The Q and $\overline{Q}$ outputs of the flip-flop are connected to the gate electrodes of transistors 20 and 21, respectively, via resistors 34 and 35, respectively. The $\overline{Q}$ output of the flip-flop is also directly connected to the D input thereof. The output frequency at each output of the flip-flop is of course one half the frequency of the output signal of the VCO 32. The inverter circuit will thus be driven at a frequency determined by the frequency of the VCO, which is in turn determined by the level of the lamp current.

As an option, windings 36, 37 and 38 may be provided on the inductor 18 in order to provide heater current for the filaments of the discharge lamps, if required. As a further option, a capacitor, not shown, may be connected in shunt with the discharge lamps if it is desired to modify the circuit to provide a sinewave drive to the lamps.

The system described above will control the lamp current by continuously sampling this current and feeding back a signal determined thereby to adjust the drive frequency of the inverter circuit in a sense to regulate the lamp current. The use of a driven inverter results in a load independent system and the use of MOS transistors will reduce the drive power requirements to a minimum.

The use of a relatively small filter capacitor 17 is made possible because of the variable frequency control of the driven inverter circuit. This control provides optimum load current regulation despite a substantial 120 Hz ripple component in the rectified DC supply voltage appearing at rectifier output terminals 15, 16 and applied to the inverter circuit.

A minimum of filtering results in a varying amplitude of the high frequency output of the inverter, which is applied to the lamp via the series reactance element. As the applied voltage varies, the lamp current would also vary, but due to the variable frequency current control provided, any load current variations produce a change in the inverter circuit frequency which will in turn vary the frequency dependent series impedance in a sense to limit the change in the lamp current. The invention thus provides a controlled AC current drive to the lamp on a cycle-by-cycle basis and with a minimum amount of filtering action.

The rectification filtering may be just sufficient to ensure that the pulsating DC voltage does not collapse below a level such that the arc extinguishes during the 120 Hz period. The use of a small filter capacitor contributes to a high power factor for the system. A higher level of filtering may of course be used depending on the required system power factor. Good regulation is provided against line and load variations.

In the case where an inductor (28) is used as a series ballast reactance element for the lamp, a maximum lamp current will occur when the inverter is driven at its lowest frequency, whereas the minimum current occurs at the upper frequency limit. The circuit provides optimum load regulation for variations in line voltage due to the variable frequency control of the driven inverter. The circuit also features an improved lamp current crest factor due to the use of the frequency feedback principle.

Figure 2:
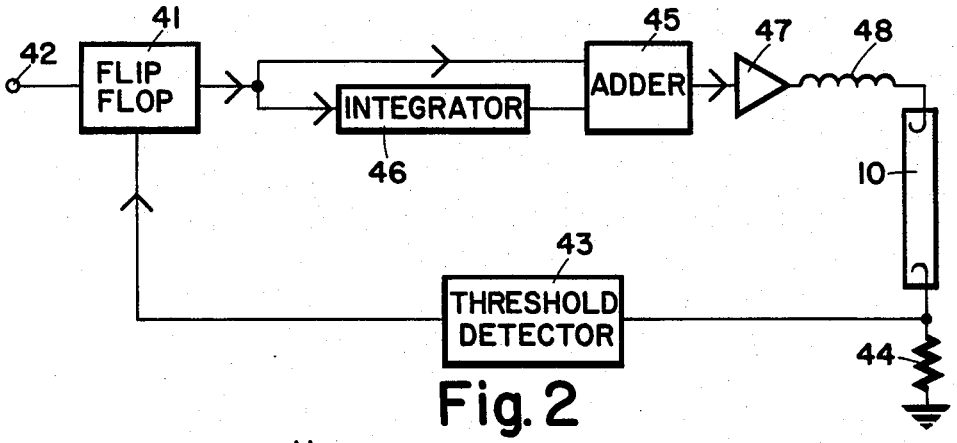
FIG. 2 is a block diagram of a second embodiment of the invention.

FIG. 2 illustrates a second preferred embodiment of the invention wherein a triggered flip-flop 41 is energized by a supply voltage applied to terminal 42. This embodiment basically comprises a triangle waveform current source driving an inductively ballasted discharge lamp. A lamp current threshold detector 43 monitors the current flowing through discharge lamp 10 and a series resistor 44. When the lamp current reaches a predetermined peak value which can be set in the threshold detector 43, the threshold detector generates a trigger pulse that triggers the flip-flop 41 and causes it to reverse its state.

The output of the flip-flop is connected directly to one input of an adder circuit 45 and to an input of an integrator circuit 46. The flip-flop 41 thus supplies a square wave signal to the adder and to the integrator circuit. The output of the integrator circuit is in turn coupled to a second input of the adder circuit and supplies thereto a triangle waveform signal. The adder circuit adds the square wave signal and the triangle waveform signal to produce at its output a trapezoidal type waveform as shown in FIG. 3.

The output of the adder circuit couples to the series circuit consisting of a power amplifier 47, a ballast inductor 48, the discharge lamp 10 and the current sensing resistor 44.

As the output voltage of the adder circuit ramps up in amplitude, the lamp current also ramps up in value until the voltage drop across the series sensing resistor 44 reaches a predetermined peak threshold level set in the threshold detector 43. At that time the threshold detector supplies a trigger pulse to flip-flop 41 to cause it to change state, as shown at time $t_1$ in FIG. 3. The integrator circuit 46 responds to the negative half of the square wave to generate a ramp voltage between $t_1$ and $t_2$ in FIG. 3 of opposite polarity but the same slope (rate of change) as that occurring between the instants of time designated 0 and $t_1$ in FIG. 3.

Figure 3:
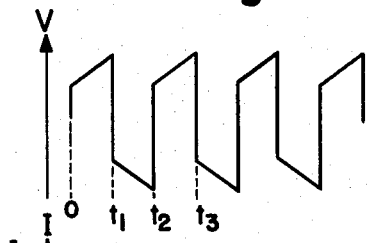
FIG. 3 shows the supply voltage waveform for the discharge lamp as a function of time in the embodiment of FIG. 2.
Figure 4:
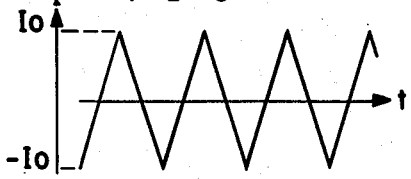
FIG. 4 shows the lamp current as a function of time in the system of FIG. 2.

It can be shown that a triangle waveform of current as shown in FIG. 4 will be generated in the discharge lamp if it is supplied with a trapezoidal voltage consisting of a square wave plus a triangular wave of the type shown in FIG. 3. The peak-to-peak amplitude of the square wave is $2I_0L/T$, where L is the ballast inductor, T is the period of one oscillation and $I_0$ is the half peak of the current. The triangular voltage has a half-peak of $I_0R$, where R is the lamp impedance. The lamp is essentially resistive at high frequency. The quantity $I_0R$ is essentially constant since the arc voltage varies very slowly with current.

At time $t_2$ in FIG. 3, the voltage drop across resistor 44 due to the negative going ramp current flowing through the lamp reaches a predetermined low threshold level, also set in threshold detector 43. The detector generates another trigger pulse to trigger the flipflop back to its first state.

The signal output of the adder circuit once again ramps up in value as shown between the points $t_2$ and $t_3$ in FIG. 3. At time $t_3$ the threshold detector once again triggers the flip-flop so that the sequence of operations described above repeats itself. For a constant load and a constant supply voltage a constant frequency trapezoidal waveform is generated. If the load impedance decreases or the supply voltage increases, the current will ramp up or down more quickly to the upper and lower threshold levels set in detector 43, thus resulting in a faster turnaround, that is a higher frequency of operation. A higher frequency signal increases the impedance of the ballast inductor 48 so as to automatically limit or regulate the lamp current.

In summary, when the lower limit of lamp current is sensed, i.e. the voltage drop across resistor 44, the threshold detector produces a pulse to trigger the flip-flop to the high state. The square wave generated by the flip-flop is integrated to form a triangular waveform and, with appropriate level setting, if necessary, the square wave and triangular wave signals are added to form a trapezoidal waveform which, in turn, will produce a triangular current in the lamp. When the voltage drop across sensing resistor 44 reaches the upper threshold value, the threshold detector triggers the flip-flop into the low state. The threshold level can be set to a given value to provide a constant lamp current. It can also be remotely adjusted to produce a dimming function and it can be adjusted by means of a photocell to provide automatic light control. For a given setting of the threshold detector, the circuit automatically compensates for ripple on the supply voltage by increasing the operating frequency as the supply voltage increases, and vice versa. The circuit automatically controls its own frequency so as to regulate the lamp current.

The amplitude of the lamp current is automatically regulated because the frequency of the generated waveform varies as the load or supply voltage changes, and in a sense so as to keep the lamp current constant.

Although the invention has been described with respect to specific embodiments thereof, it will be appreciated that various modifications and changes may be made by those skilled in the art without departing from the true spirit and scope of the invention.

We claim:

1. A circuit for controlling a gas discharge lamp comprising, a variable frequency waveform generator having input means for connection to a source of supply voltage, a non-resonant coupling network including a reactive ballast impedance coupled between an output of said waveform generator and said discharge lamp, means responsive to the current flowing through said discharge lamp for monitoring the level of said lamp current, and frequency control means having an input coupled to said current monitoring means and an output coupled to said waveform generator for supplying a frequency control signal thereto so as to alter the frequency of the waveform generator as a function of the lamp current and in a sense to regulate the lamp current within predetermined limits, wherein said frequency control means comprises a threshold detector for deriving trigger pulses at first and second levels of lamp current, and said waveform generator comprises a trapezoidal waveform generator coupled to the output of the threshold detector for supplying a trapezoidal waveform signal to said ballast impedance and to said discharge lamp connected in series circuit.

2. A control circuit as claimed in claim 1 wherein said trapezoidal wave form generator comprises, a bistable device having an input coupled to receive said trigger pulses from the threshold detector and an output for supplying a square wave signal whose frequency is determined by the trigger pulses, an adder circuit having an output connected to the series circuit comprising the ballast impedance and discharge lamp and having one input coupled to the output of the bistable device, and an integrator device coupled between the output of the bistable device and a second input of the adder circuit.

3. A circuit for controlling a gas discharge lamp comprising: a variable frequency waveform generator having input means for connection to a source of supply voltage, a reactive ballast impedance connected in series circuit with said discharge lamp to an output of the waveform generator, means responsive to lamp current for deriving a signal determined by the level of lamp current, frequency control means including a threshold detector having an input which receives said signal thereby to derive trigger pulses at first and second given levels of said lamp current, means coupling an output of the threshold detector to a control input of the waveform generator for supplying said trigger pulses thereto thereby to vary the frequency of the waveform generator as a function of the lamp current and in a sense to regulate the lamp current, and wherein said waveform generator comprises a trapezoidal waveform generator for supplying a trapezoidal waveform signal to said series circuit comprising the discharge lamp and the ballast impedance.

4. A control circuit as claimed in claim 3 wherein said trapezoidal waveform generator comprises, a bistable device having an input coupled to receive said trigger pulses from the threshold detector and an output for supplying a square wave signal whose frequency is determined by the trigger pulses, an adder circuit having an output connected to the series circuit comprising the ballast impedance and discharge lamp and having one input coupled to the output of the bistable device, and an integrator device coupled between the output of the bistable device and a second input of the adder circuit.

5. A control circuit as claimed in claim 3 wherein the ballast impedance comprises an inductor.

* * * * *